US009593460B2

(12) United States Patent
Knuth

(10) Patent No.: US 9,593,460 B2
(45) Date of Patent: Mar. 14, 2017

(54) FLUID CONVEYANCE SYSTEM FOR INDUSTRIAL MACHINE

(71) Applicant: Harnischfeger Technologies, Inc., Wilmington, DE (US)

(72) Inventor: Jason Knuth, Brookfield, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 267 days.

(21) Appl. No.: 14/033,428

(22) Filed: Sep. 20, 2013

(65) Prior Publication Data

US 2014/0086716 A1 Mar. 27, 2014

Related U.S. Application Data

(60) Provisional application No. 61/704,050, filed on Sep. 21, 2012.

(51) Int. Cl.

| | |
|---|---|
| ***E02F 3/30*** | (2006.01) |
| ***E02F 3/36*** | (2006.01) |
| ***E02F 3/46*** | (2006.01) |
| ***E02F 9/20*** | (2006.01) |
| ***E02F 9/22*** | (2006.01) |

(52) U.S. Cl.

CPC ..... *E02F 3/36* (2013.01); *E02F 3/304* (2013.01); *E02F 3/46* (2013.01); *E02F 9/202* (2013.01); *E02F 9/2016* (2013.01); *E02F 9/2275* (2013.01); *Y10T 137/6954* (2015.04)

(58) Field of Classification Search

CPC ..... E02F 3/36

USPC ..... 242/388.6

See application file for complete search history.

(56) References Cited

U.S. PATENT DOCUMENTS

| | | | | |
|---|---|---|---|---|
| 1,410,201 | A * | 3/1922 | Lutz | 414/692 |
| 2,443,763 | A * | 6/1948 | Dahlgren | H02K 7/1012 191/12.2 A |
| 2,656,059 | A * | 10/1953 | Troyer | B66C 1/585 414/731 |
| 2,781,926 | A | 2/1957 | Sights | |
| 3,219,213 | A | 11/1965 | Learmont | |
| 3,349,932 | A | 10/1967 | Wagner | |
| 3,425,574 | A | 2/1969 | Willgrubs et al. | |

(Continued)

FOREIGN PATENT DOCUMENTS

| | | |
|---|---|---|
| WO | 9927197 | 6/1999 |
| WO | 2010138122 | 2/2010 |

(Continued)

*Primary Examiner* — Gerald McClain
*Assistant Examiner* — Ronald Jarrett
(74) *Attorney, Agent, or Firm* — Michael Best & Friedrich LLP

(57) ABSTRACT

An industrial machine includes a frame supporting a boom, an elongated member movably coupled to the boom, an attachment, a conduit, and a reel supporting at least a portion of the conduit. The boom includes a first end coupled to the frame and a second end opposite the first end. The elongated member is movably coupled to the boom and includes a first end and a second end. The attachment is coupled to the second end of the elongated member. The conduit extends between the frame and the attachment. The reel is rotatably supported on a support shaft. The reel rotates about an axis of rotation to reel in and pay out the conduit as the elongated member moves relative to the boom.

33 Claims, 8 Drawing Sheets

(56) References Cited

U.S. PATENT DOCUMENTS

| | | | | |
|---|---|---|---|---|
| 3,452,890 | A | 7/1969 | Learmont | |
| 3,465,903 | A | 9/1969 | Wilson | |
| 3,485,394 | A | 12/1969 | Burkart | |
| 3,485,395 | A | 12/1969 | Windahl | |
| 3,610,433 | A | 10/1971 | Milner et al. | |
| 3,648,863 | A | 3/1972 | Baron et al. | |
| 3,709,252 | A * | 1/1973 | Bishop | 137/355.17 |
| 3,958,594 | A * | 5/1976 | Masters | B65H 75/38 137/355.12 |
| 3,959,897 | A | 6/1976 | May | |
| 4,011,699 | A * | 3/1977 | Mickelson | B66C 23/705 212/288 |
| 4,156,436 | A | 5/1979 | Hawk | |
| 4,273,066 | A | 6/1981 | Anderson | |
| 4,276,918 | A | 7/1981 | Sigouin | |
| 4,509,895 | A | 4/1985 | Baron | |
| 4,723,568 | A * | 2/1988 | Adams | 137/355.17 |
| 4,958,981 | A | 9/1990 | Uchihashi | |
| 5,114,091 | A * | 5/1992 | Peterson | H04M 1/15 242/375 |
| 5,419,654 | A | 5/1995 | Kleiger | |
| 5,423,654 | A | 6/1995 | Rohrbaugh | |
| 5,469,647 | A | 11/1995 | Profio | |
| 5,499,463 | A | 3/1996 | Profio et al. | |
| 5,659,470 | A | 8/1997 | Goska et al. | |
| 5,836,232 | A * | 11/1998 | Williams | 92/14 |
| 6,025,686 | A | 2/2000 | Wickert et al. | |
| 6,219,946 | B1 | 4/2001 | Soczka | |
| 6,718,663 | B1 | 4/2004 | Geraghty | |
| 7,152,349 | B1 | 12/2006 | Rowlands | |
| 7,153,082 | B2 | 12/2006 | Nolasco | |
| 7,174,826 | B2 | 2/2007 | Kerrigan et al. | |
| RE40,869 | E | 8/2009 | Leslie et al. | |
| 7,877,906 | B2 | 2/2011 | Ramun | |
| 7,950,171 | B2 | 5/2011 | Wurster | |
| 7,984,575 | B2 | 7/2011 | Robl et al. | |
| 8,032,313 | B2 | 10/2011 | Claxton | |
| 2005/0163603 | A1 | 7/2005 | Kerrigan et al. | |
| 2007/0039860 | A1 | 2/2007 | Krock et al. | |
| 2007/0107269 | A1 | 5/2007 | Hren et al. | |
| 2010/0131157 | A1* | 5/2010 | Kahle | E02F 9/2267 701/50 |
| 2011/0033273 | A1 | 2/2011 | Geraghty | |
| 2011/0251935 | A1 | 10/2011 | German et al. | |
| 2013/0195594 | A1 | 8/2013 | Knuth | |
| 2013/0280021 | A1 | 10/2013 | Knuth | |
| 2014/0099179 | A1 | 4/2014 | Jones | |

FOREIGN PATENT DOCUMENTS

| | | |
|---|---|---|
| WO | 2010140996 | 12/2010 |
| WO | 2010141007 | 12/2010 |

* cited by examiner

FLUID CONVEYANCE SYSTEM FOR INDUSTRIAL MACHINE

CROSS REFERENCE TO RELATED APPLICATION

This application claims the benefit of and priority to U.S. Provisional Patent Application No. 61/704,050, filed Sep. 21, 2012, the entire contents of which is incorporated by reference herein.

BACKGROUND

The present invention relates to industrial machines. Specifically, the present invention relates to a fluid conveyance system for a earthmoving machine attachment.

Conventional rope shovels include a frame supporting a boom and a handle coupled to the boom for rotational and translational movement. A dipper is attached to the handle and is supported by a cable or rope that passes over an end of the boom. The rope is secured to a bail that is pivotably coupled to the dipper. During the hoist phase, the rope is reeled in by a hoist drum, lifting the dipper upward through a bank of material and liberating a portion of the material. The orientation of the dipper relative to the handle is generally fixed and cannot be controlled independently of handle and hoist rope.

SUMMARY

In one aspect, the invention provides an industrial machine including a frame supporting a boom, an elongated member movably coupled to the boom, an attachment, a conduit, and a reel supporting at least a portion of the conduit. The boom includes a first end coupled to the frame and a second end opposite the first end. The elongated member is movably coupled to the boom and includes a first end and a second end. The attachment is coupled to the second end of the elongated member. The conduit extends between the frame and the attachment. The reel is rotatably supported on a support shaft. The reel rotates about an axis of rotation to reel in and pay out the conduit as the elongated member moves relative to the boom.

In another aspect, the invention provides an industrial machine including a frame supporting a fluid source and a boom, a handle movably coupled to the boom for translational and rotational movement relative to the boom, an attachment coupled to the handle, a conduit, a first reel, and a second reel. The conduit includes a first portion, a second portion, and a fluid coupling. The first portion is in fluid communication with a portion of the attachment. The second portion is in fluid communication with the fluid source. The fluid coupling includes a first end in fluid communication with the first portion of the conduit and a second end in fluid communication with the second portion of the conduit. The first reel supports the first portion of the conduit and is rotatable to reel in and pay out the first portion of conduit as the attachment moves relative to the boom. The second reel supports the second portion of the conduit and is rotatable to reel in and pay out the second portion of the conduit as the attachment moves relative to the boom.

In yet another aspect, the invention provides a fluid conveyance system for an industrial machine having a frame supporting a fluid source and a boom, an elongated member movably coupled to the boom and having a first end and a second end, and an attachment coupled to the second end of the elongated member. The fluid conveyance system includes a conduit for providing fluid to a portion of the attachment, a support shaft defining an axis of rotation, a first reel rotatably supported on the support shaft, and a second reel. The conduit includes a first portion, a second portion, and a fluid coupling. The second portion is configured to be in fluid communication with the fluid source. The fluid coupling provides fluid communication between the first portion and the second portion. The first reel supports the first portion of the conduit and is rotatable about the axis of rotation to reel in and pay out the first portion. The second reel supports the second portion of the conduit and is rotatable to reel in and pay out the second portion.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
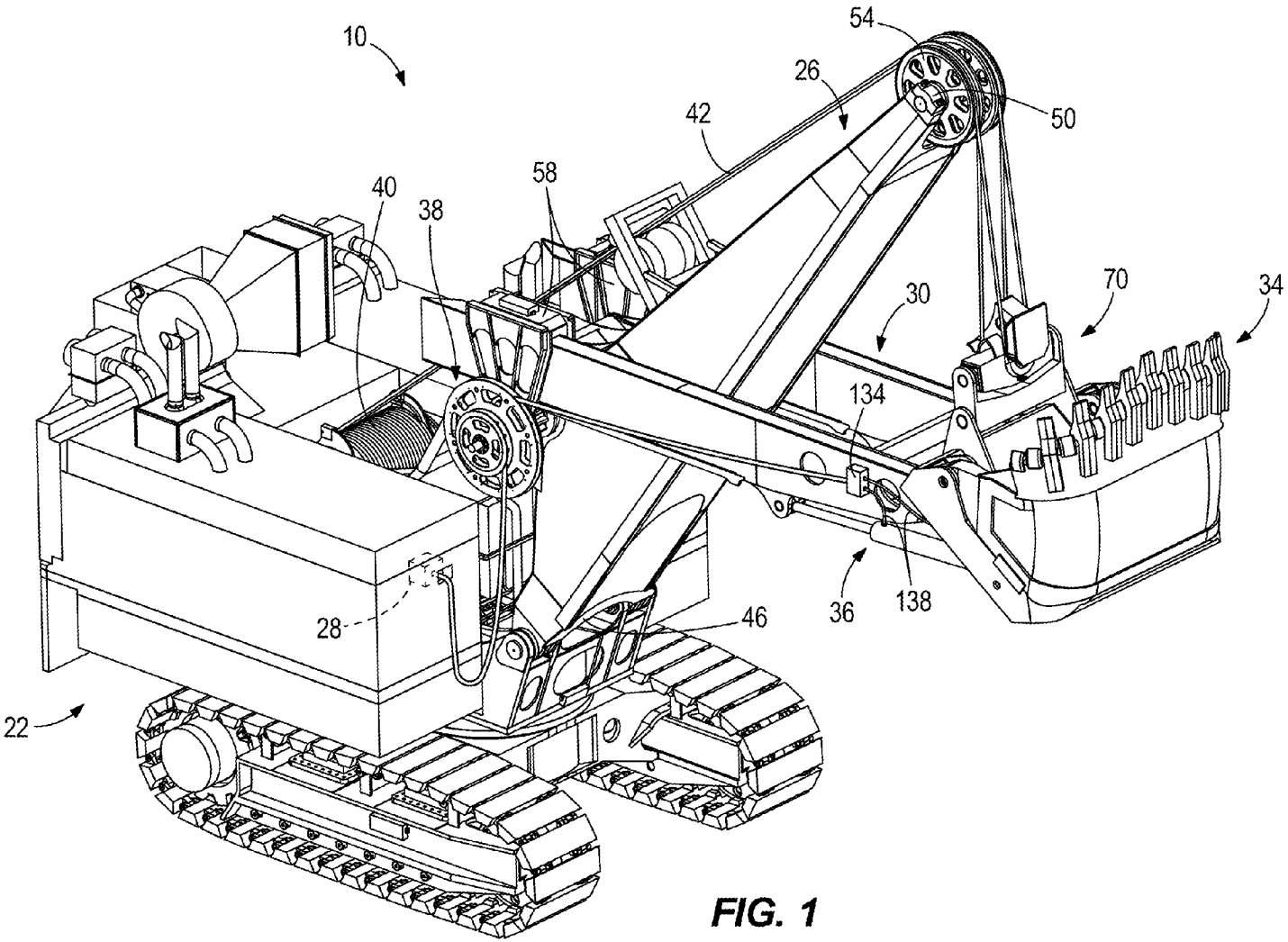
FIG. 1 is a perspective view of a mining shovel.
Figure 2:
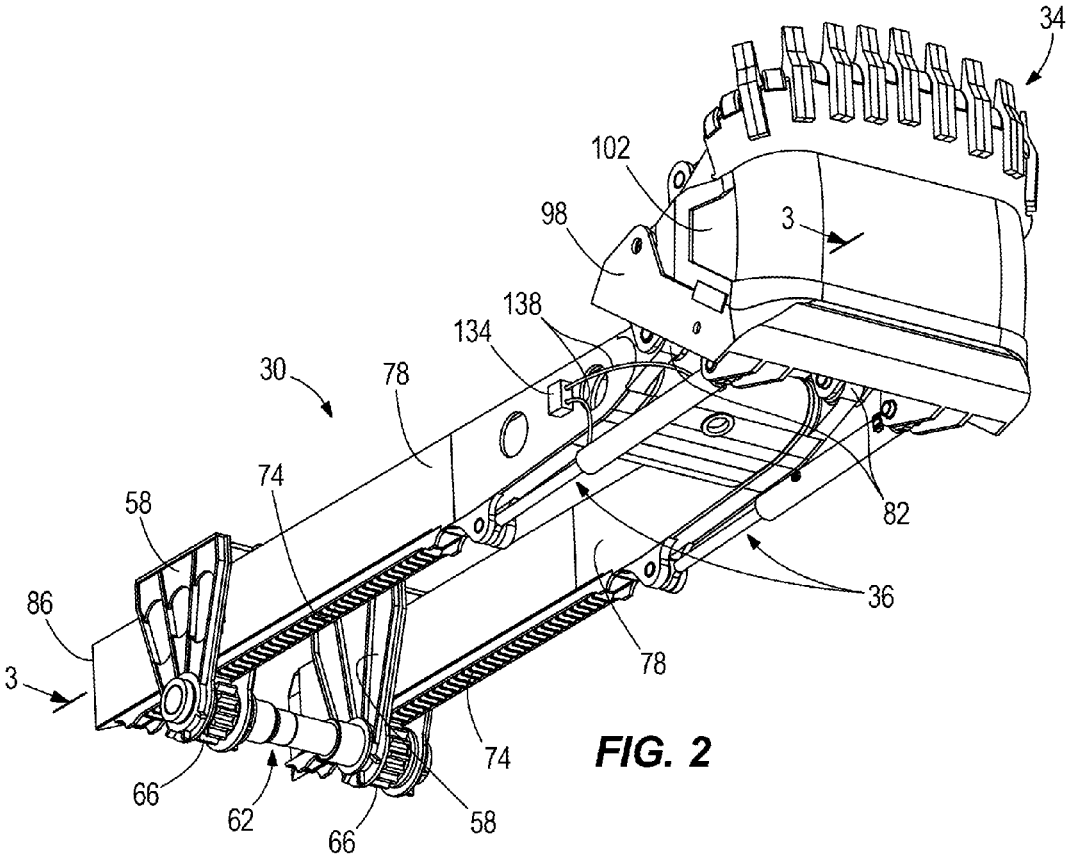
FIG. 2 is a perspective view of a handle, a saddle block, a shipper shaft, and a bucket.
Figure 3:
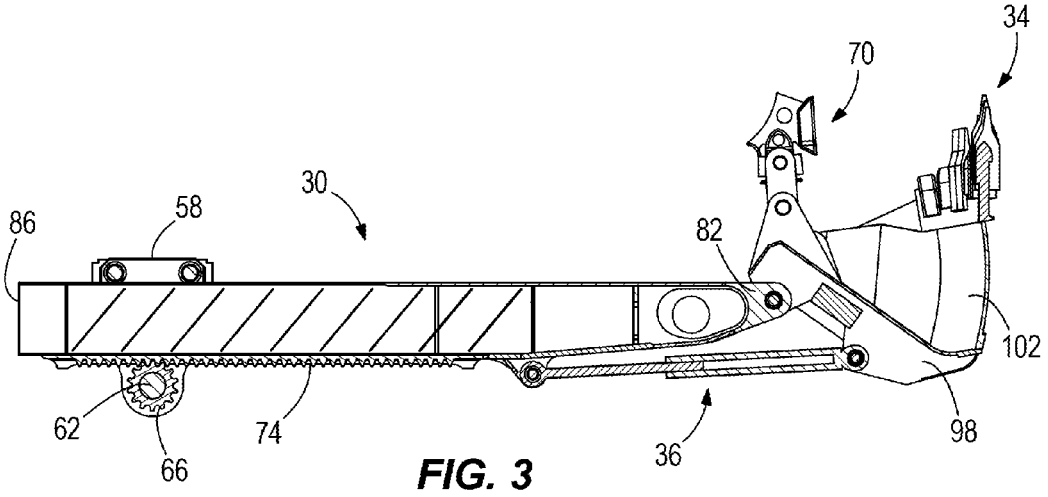
FIG. 3 is a section view of the handle, saddle block, shipper shaft and bucket of FIG. 2 taken along section 3-3.

As shown in FIG. 1, a mining shovel 10 rests on a support surface or ground, and includes a frame 22 supporting a boom 26 and a fluid source 28 (e.g., a fluid pump), an elongated member or handle 30, an attachment or bucket 34 including pivot actuators 36, and a fluid conveyance system 38. The frame 22 includes a hoist drum 40 for reeling in and paying out a cable or hoist rope 42. The boom 26 includes a first end 46 coupled to the frame 22, a second end 50 opposite the first end 46, a boom sheave 54, a saddle block 58, and a shipper shaft 62 (FIG. 2). The boom sheave 54 is coupled to the second end 50 of the boom 26 and guides the rope 42 over the second end 50. The saddle block 58 is rotatably coupled to the boom 26 by the shipper shaft 62, which is positioned between the first end 46 and the second end 50 of the boom 26. The shipper shaft 62 extends through the boom 26 in a direction that is transverse to a longitudinal axis of the boom 26, and the shipper shaft 62 includes one or more pinions 66 (FIGS. 2 and 3). The rope 42 is coupled to the bucket 34 by a bail 70, and the bucket 34 is raised or lowered as the rope 42 is reeled in or paid out, respectively, by the hoist drum 40.

As best shown in FIGS. 2 and 3, the handle 30 includes a pair of arms 78 defining a first end 82 and a second end 86. The first end 82 is pivotably coupled to the bucket 34. The second end 86 is movably received in the saddle block 58, which is rotatable relative to the boom 26 (FIG. 1) about the shipper shaft 62. The handle arms 78 movably pass through each saddle block 58 such that the handle 30 is capable of rotational and translational movement relative to the boom 26 (FIG. 1). Stated another way, the handle 30 is linearly extendable relative to the saddle block 58 and is rotatable about the shipper shaft 62. In the illustrated embodiment, the handle 30 is substantially straight. In other embodiments, the handle 30 may include a curved portion. The handle 30 also includes a rack 74 for engaging the pinion 66, forming a rack-and-pinion coupling between the handle 30 and the boom 26. Rotation of the shipper shaft 62 facilitates translational movement of the handle 30 relative to the boom 26.

In the illustrated embodiment, the bucket 34 is a clamshell-type bucket 34 having a rear wall 98 and a main body 102 that can be separated from the rear wall 98 to empty the contents of the bucket 34. In other embodiments, the shovel 10 may include other types of attachments, buckets, or dippers. Each pivot actuator 36 is coupled between the bucket 34 and the handle 30. The pivot actuators 36 actively control the pitch of the bucket 34 (i.e., the angle of the bucket 34 relative to the handle 30) by rotating the bucket 34 about the handle first end 82. In the illustrated embodiment, the pivot actuators 36 are hydraulic cylinders.

Figure 4:
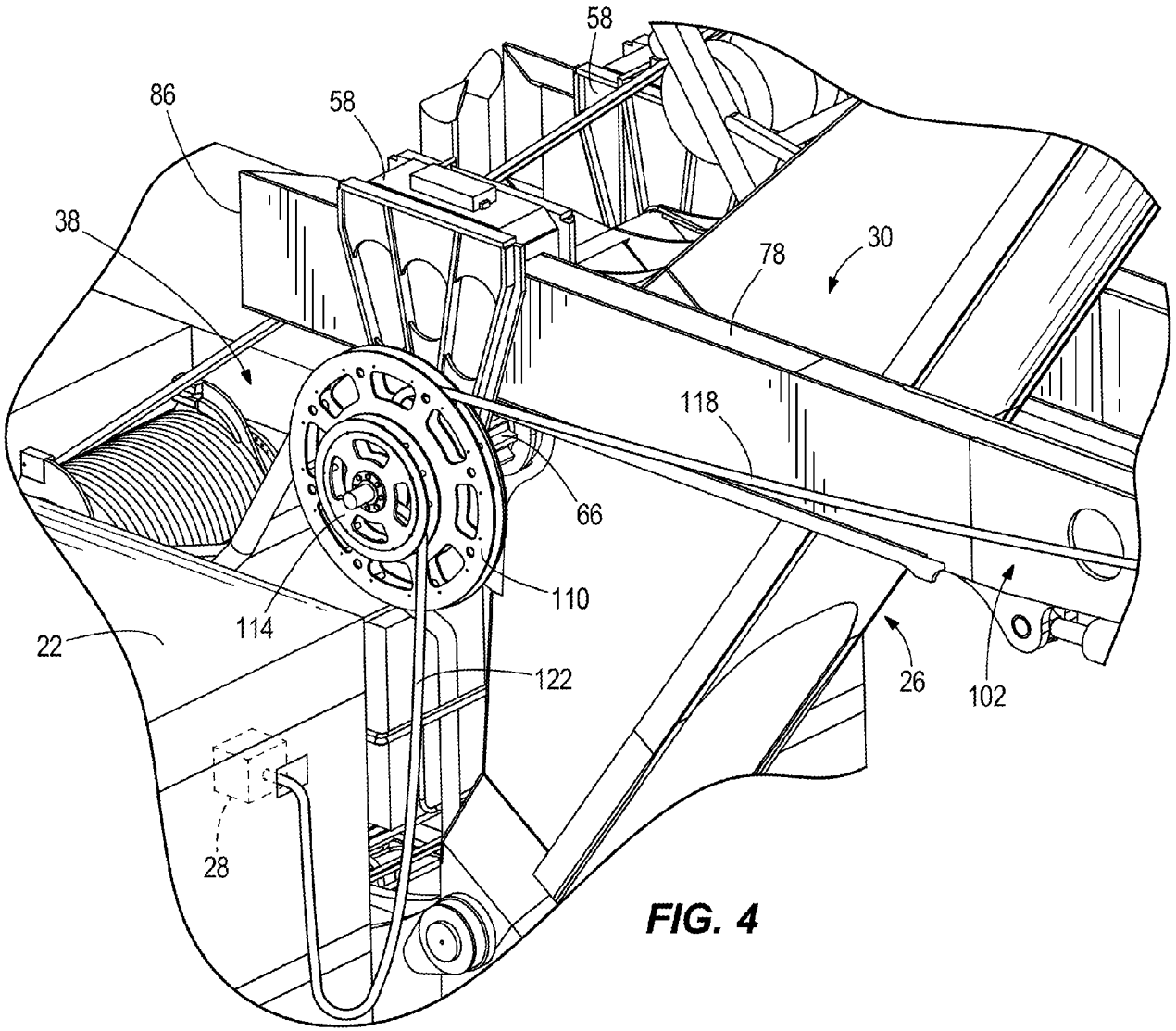
FIG. 4 is a perspective view of fluid conveyance system with the handle extended.
Figure 5:
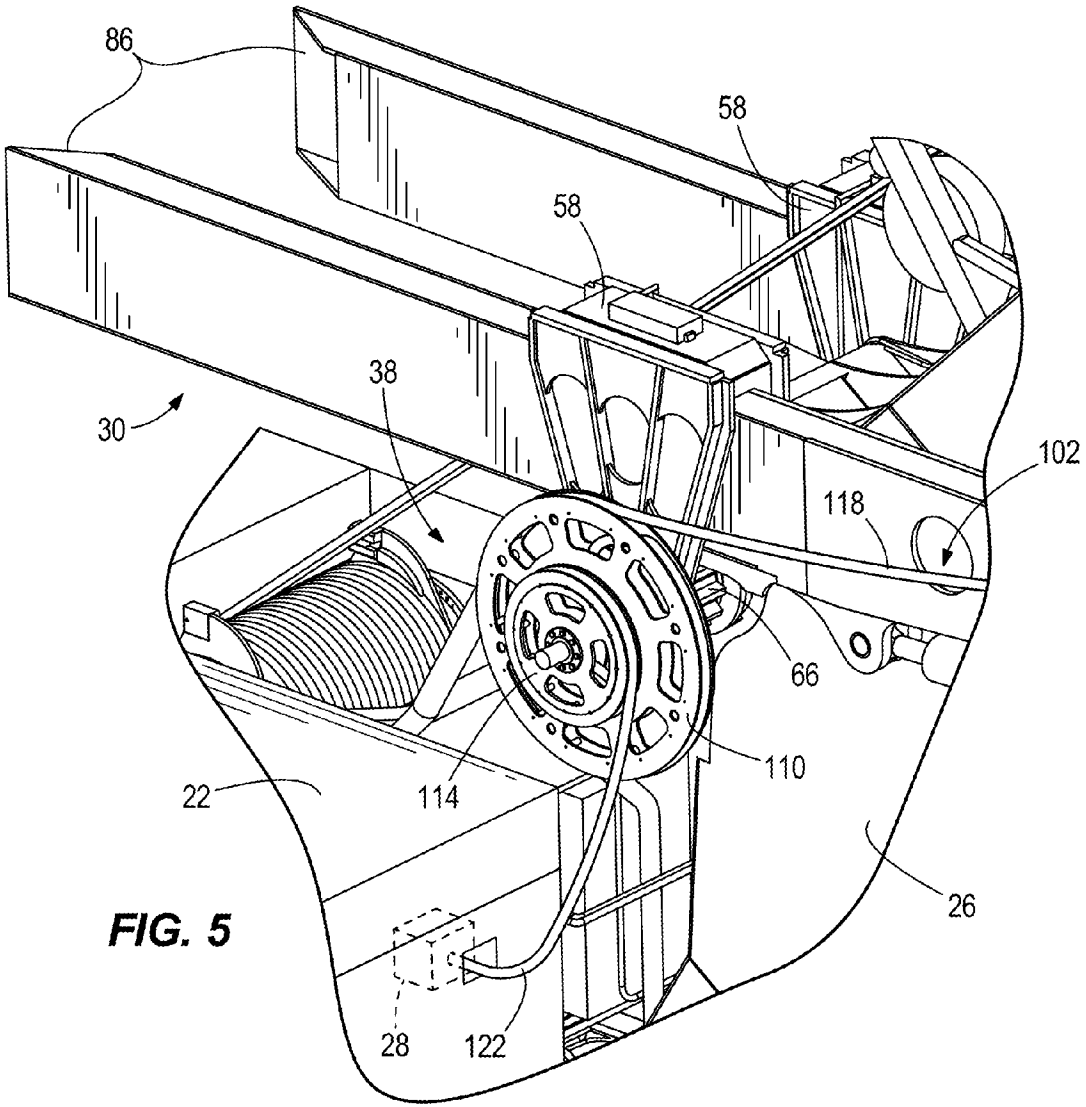
FIG. 5 is a perspective view of a fluid conveyance system with the handle retracted.

As shown in FIGS. 4 and 5, the fluid conveyance system 38 includes a conduit 102, a first reel 110, and a second reel 114. In some embodiments, a fluid conveyance system 38 is positioned on each side of the handle 30.

The conduit 102 includes a first portion 118 that is at least partially wrapped around the first reel 110 and a second portion 122 that is at least partially wrapped around the second reel 114. In the illustrated embodiment, the first portion 118 extends from the first reel 110 toward the first end 82 of the handle 30 and includes an end in fluid communication with a valve block or manifold 134 (FIG. 1). The second portion 122 of the conduit extends between the fluid source 28 and the second reel 114. The first portion 118 and the second portion 122 are in fluid communication with one another by a fluid tube 146 (FIGS. 6 and 7), which is discussed in greater detail below.

As shown in FIGS. 1 and 2, the manifold 134 is coupled to the handle 30 proximate the first end 82 and includes lines 138 that supply pressurized fluid to the pivot actuators 36, which are illustrated as double-acting hydraulic cylinders. In some embodiments, the lines 138 supply pressurized fluid to bucket actuators (not shown) for pivoting the main body 102 relative to the rear wall 98. In some embodiments, the manifold 134 provides fluid communication between the first portion 118 (FIG. 4) of the conduit 102 and various mechanical connections on the bucket 34 and the handle 30 to provide lubricative fluid to the connections. The lubricative fluid may be a liquid, solid, and/or semi-solid (e.g., grease). Alternatively, the conduit 102 may include separate parallel lines to convey both lubricative fluid and hydraulic fluid, and may include parallel electrical and communication lines. In still other embodiments, the lines 138 and/or the first portion 118 may extend along an inner surface of the handle 30. Furthermore, in other embodiments, the first portion 118 may extend from the reel 110 (FIG. 4) toward the second end 86 of the handle 30 and then extend along the length of the handle 30 toward the first end 82.

Figure 6:
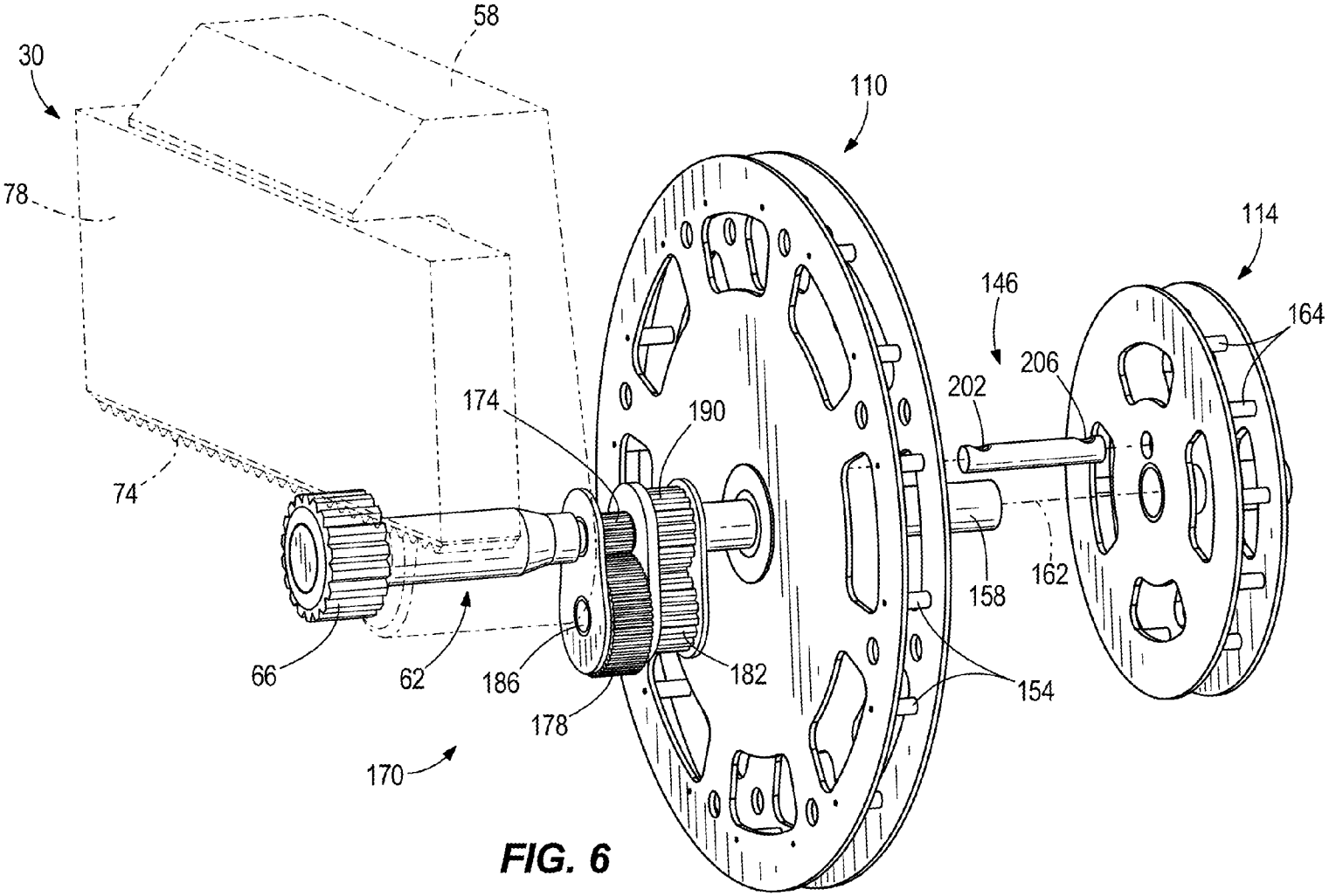
FIG. 6 is partial exploded perspective view of a hose reel and a transmission.
Figure 7:
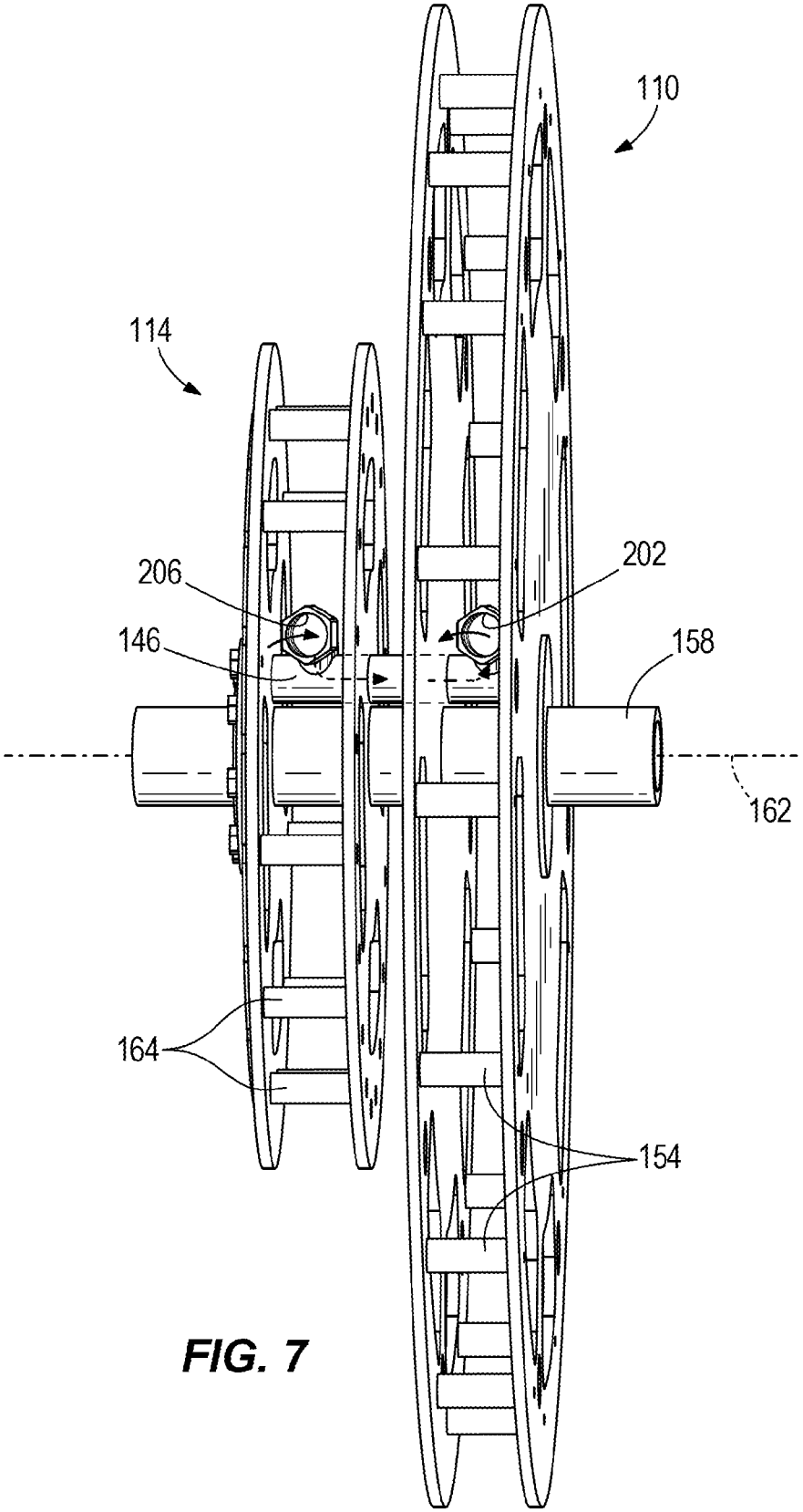
FIG. 7 is a front view of the hose reel of FIG. 6.

Referring to FIGS. 6 and 7, the first reel 110 includes multiple pins 154 positioned around the circumference of the reel 110, and the first portion 118 (FIG. 5) of the conduit 102 is wrapped and unwrapped around the pins 154 as the reel 110 rotates. In other embodiments, the pins 154 may be substituted as a continuous surface. The first reel 110 is supported for rotation by a support shaft 158 and is rotatable about an axis 162. In the illustrated embodiment, the second reel 114 is also supported for rotation by the support shaft 158 and rotates about the axis 162. In the illustrated embodiment, the first reel 110 and the second reel 114 are coupled together such that both reels 110, 114 rotate about the axis 162 in the same direction and at the same speed. In other embodiments, the second reel 114 may rotate independently of the first reel 110, including rotating in an opposite direction and/or rotating at a different speed than the first reel 110. The second reel 114 also includes pins 164 around which the second portion 122 (FIG. 5) of the conduit 102 is wrapped. In addition, the first reel 110 of has a larger diameter than the second reel 114. The smaller second reel 114 reduces weight and the second portion 122 can be sized to reduce the slack due to rotation of the second reel 114. In other embodiments, the reels 110, 114 could be the same size, or the second reel 114 could be larger than the first reel 110.

As shown in FIG. 6, the support shaft 158 is driven by a transmission 170. In the illustrated embodiment, the transmission 170 includes a dual reduction, parallel shaft gear drive; in other embodiments, the transmission 170 may include another type of mechanism. The transmission 170 includes a pinion 174 coupled to the shipper shaft 62 and engaging a first gear 178. The first gear 178 is coupled to a second gear 182 (for example, by mounting on a common shaft 186), which engages a drive gear 190 coupled to the support shaft 158. Rotation of the drive gear 190 rotates the first reel 110 and the second reel 114. The transmission 170 is coupled to the saddle block 58, boom 26 (FIG. 1), or another structure unaffected by the motion of the rack-and-pinion connection between the handle 30 and the shipper shaft 62.

In the illustrated embodiment, the transmission 170 causes the first reel 110 to rotate in the same direction as the shipper shaft 62 and establishes a timing relationship between the angular displacement of the shipper shaft 62 and the angular displacement of the first reel 110. This relationship utilizes the crowd motion of the handle 30 to pay out and reel in the correct length of the conduit 102, thereby avoiding excessive tension on the conduit 102 when the handle 30 is extended and limiting the amount of slack when the handle 30 is retracted. In other embodiments, the gears 174, 178, 182, and 190 may be sized differently in order to provide a desired speed reduction between the shipper shaft 62 and the first reel 110. In still other embodiments, the transmission may be a planetary gear transmission.

Furthermore, the first reel 110 and the second reel 114 may be independently driven (e.g., mounted on separate shafts), and the first portion 118 and second portion 122 may be coupled by a swivel or rotary union or other fluid coupling to accommodate independent movement of the reels 110, 114. Alternatively, the first reel 110 and the second reel 114 may be coupled by a second transmission that establishes a timing relationship between the first reel 110 and the second reel 114. In still other embodiments, the reels 110, 114 may be directly fixed to the shipper shaft 62 to provide a direct timing relationship. In other embodiments, the rotation of the reels 110, 114 can be controlled by a separate motor, such as a torque-controlled motor that maintains a relatively constant tension on the conduit 102.

As shown in FIGS. 6 and 7, the fluid tube 146 extends between the first reel 110 and the second reel 114. The fluid tube 146 includes a first port 202 in fluid communication with the first portion 118 (FIG. 3) of the conduit 102 and a second port 206 in fluid communication with the second portion 122 (FIG. 3) of the conduit 102. The first port 202 is positioned proximate the first reel 110, and the second port 206 is positioned proximate the second reel 114. The fluid tube 146 extends between the reels 110, 114 at a position that is offset from the axis of rotation 162. In other embodiments, the tube 146 may extend through the support shaft 158 such that the fluid tube 146 is aligned with the axis 162.

As shown in FIG. 7, each port 202, 206 may be coupled to the respective portion of the conduit 102 using any known type of conventional fluid coupling. Although the fluid couplings in the illustrated embodiment is positioned within the circumference of the pins 154 of the first reel 110 and within the circumference of the pins 164 of the second reel 114, it is understood that the couplings may include a portion extending outwardly between the pins 154, 164 to engage the first portion 118 and the second portion 122, respectively.

Referring to FIGS. 4 and 5, as the shipper shaft 62 (FIG. 2) rotates, the handle 30 will either extend or retract with respect to the boom 26. As the handle 30 is extended (FIG. 4), the first reel 110 rotates in a first direction (clockwise in FIG. 4) to pay out the first portion 118 of the conduit 102 to accommodate the extension. The rotation of the shipper shaft 62 drives the transmission 170 (FIG. 6) and causes the support shaft 158 (FIG. 6) and the reels 110 and 114 to rotate at a predetermined rate. The second reel 114 pays out the second portion 122 of the conduit 102, which is suspended in a slack state beneath the second reel 114. When the handle 30 is retracted (FIG. 5), the reels 110, 114 rotate in a second direction (counter-clockwise in FIG. 4) opposite the first direction, with the first reel 110 winding up the first portion 118 and the second reel 114 winding up the second portion 122.

In the illustrated embodiment, the circumference of the outer surface of the pins 154 is approximately equal to a maximum extension length of the handle 30 (i.e., the length of the rack, also referred to as the crowd distance). As a results, the first reel 110 rotates through approximately 360 degrees or one full revolution as the handle 30 is retracted or extended, thereby causing the first portion 118 of the conduit 102 to wrap once around the pins 154 when the handle 30 is fully retracted (FIG. 5). In other embodiments, the first reel 110 may be sized such that the reel 110 rotates through more or less than 360 degrees as the handle 30 is extended and refracted.

Also, in the illustrated embodiment, the first reel 110 rotates clockwise as the handle 30 is extended and counter-clockwise as the handle 30 is retracted. In other embodiments, the first portion 118 of conduit 102 may be wrapped onto the reel 110 such that the reel 110 rotates counter-clockwise as the handle 30 is extended. In still other embodiments wherein the reels 110 and 114 are mounted together, the first portion 118 can be wrapped onto the first reel 110 in a first direction (e.g., clockwise) and the second portion 122 wrapped onto the second reel 114 in an opposite direction (e.g., counter-clockwise) so that the reels simultaneously pay out and wind in their respective conduit portions. Additionally, in other embodiments in which the first portion 118 extends directly from the first reel 110 to the rear or second end 86 of the handle 30, the conduit 102 is wrapped around the first reel 110 as the handle 30 is extended. In embodiments wherein the reels 110, 114 are independently mounted, the reels 110, 114 can be controlled to rotate in opposite directions from one another so that when one reel is winding up a portion of the conduit, the other reel is paying out conduit.

In some embodiments, the first portion 118 may wrap onto the pins 154 of the first reel 110 multiple times at the same diameter (i.e., sequential wrappings of the conduit 102 are positioned side-by-side on the reel 110) to match the timing of the handle to the shipper shaft. In other embodiments, the first portion 118 can be wrapped on itself. The latter configuration would cause the effective diameter of the first reel 110 to change as the first portion 118 wraps onto the reel 110. Although this configuration would require the length of the first portion 118 to be greater than the extension distance of the handle 30, it would also permit the size of the first reel 110 to be reduced.

Figure 8:
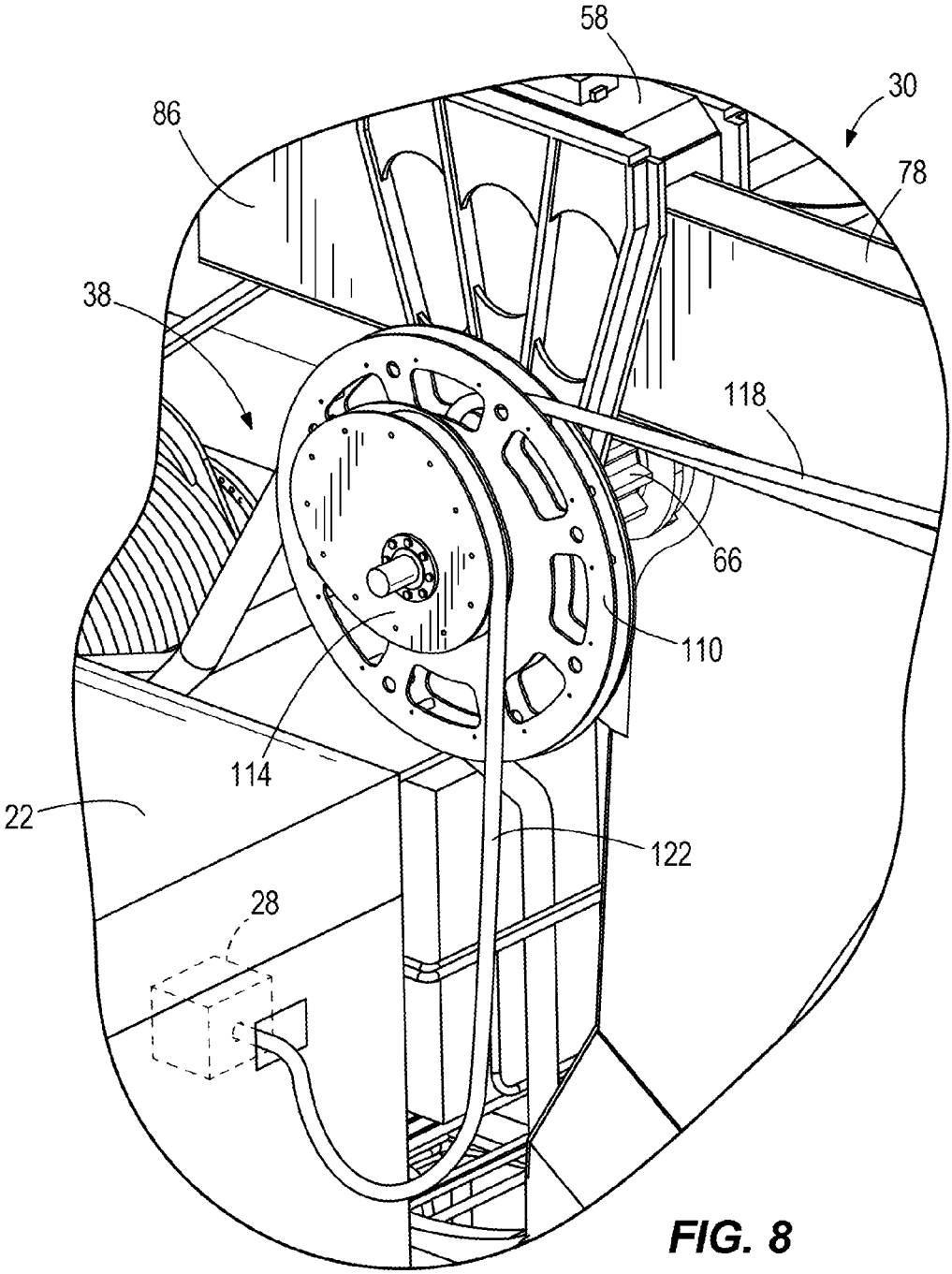
FIG. 8 is a perspective view of a fluid conveyance system according to another embodiment.

FIG. 8 illustrates another embodiment in which the second reel 110 has an oblong shape (e.g., an egg-shape or an elliptical shape). The oblong shape of the second reel 114 reduces the amount of the second portion 122 of conduit 102 that is paid out, thereby reducing the sagging in the second portion 122 of the conduit 102 (e.g., when the handle 30 is extended). In other embodiments, the second reel 110 rotates about the same axis as the first reel 110 but is eccentrically positioned with respect to the axis. In still other embodiments, an axis of rotation for the second reel 114 may be offset from an axis of rotation of the second reel 110 such that the axes are non-collinear.

Figure 9:
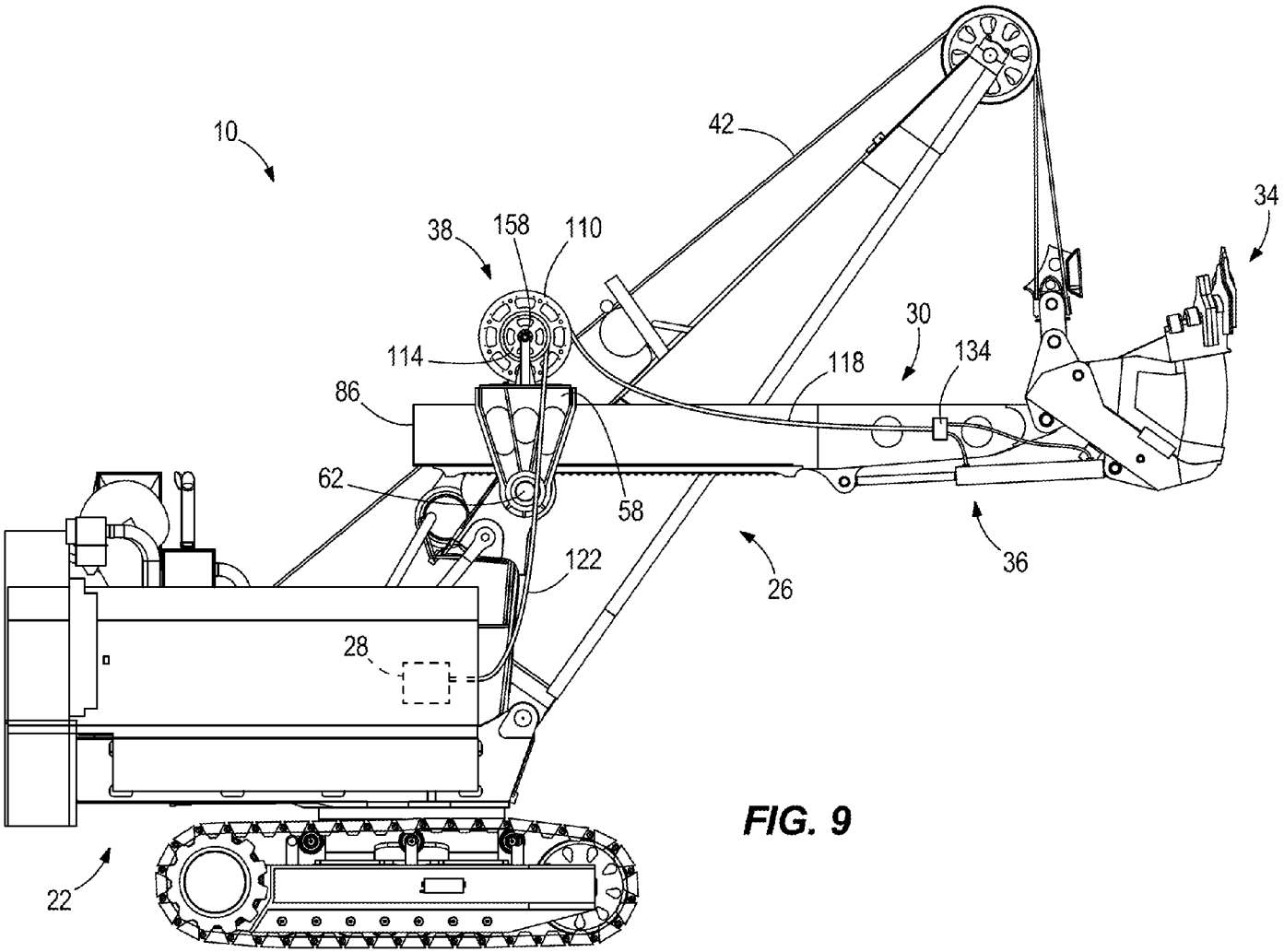
FIG. 9 is a side view of a mining shovel according to another embodiment.

FIG. 9 illustrates another embodiment of the fluid conveyance system 38 in which the first reel 110 and the second reel 114 are supported on the shovel 10 independent from the shipper shaft 62. In this embodiment, the rotation of the reels 110, 114 is driven by a separate controller including a power source such as a motor (not shown) coupled to the shaft 158. The controller may also include a tensioner and/or load sensors for measuring the tension and or catenary loading on the conduit 102. As the handle 30 extends and retracts, the motor applies a torque on the shaft 158 to maintain a desired tension on the conduit 102.

Thus, the invention provides, among other things, a fluid conveyance system for a mining shovel. Although the invention has been described in detail with reference to certain preferred embodiments, variations and modifications exist within the scope and spirit of one or more independent aspects of the invention as described.

What is claimed is:

1. An industrial machine comprising:

a frame supporting a boom, the boom including a first end coupled to the frame, a second end opposite the first end, and a shipper shaft extending transversely through the boom, the shipper shaft positioned between the first end and the second end;

a fluid source positioned on the frame;

an elongated member movably coupled to the boom and driven by rotation of the shipper shaft, the elongated member including a first end and a second end;

an attachment coupled to the second end of the elongated member;

a conduit providing fluid communication between the fluid source on the frame and the attachment, the conduit including a first portion, a second portion, and a coupling providing fluid communication between the first portion and the second portion, the second portion including a first end in fluid communication with the fluid source and a second end in fluid communication with the coupling, the first portion including a first end in fluid communication with the coupling and a second end in fluid communication with the attachment such that fluid flows sequentially from the fluid source through the second portion, the coupling, and the first portion;

a first reel supporting the first portion of the conduit, the first reel being rotatably supported on a support shaft, the first reel rotating about an axis of rotation to reel in and pay out the first portion of the conduit in response to movement of the elongated member relative to the boom;

a second reel rotatable with the first reel about the axis of rotation, the second reel supporting the second portion of the conduit, rotation of the second reel about the axis of rotation selectively reels in and pays out the second portion of the conduit in response to rotation of the shipper shaft; and a gear transmission for transmitting torque from the shipper shaft to the support shaft, the gear transmission including a pinion and at least one gear member, the pinion coupled to the shipper shaft, the pinion driving the at least one gear member to rotate the support shaft at a predetermined speed relative to the shipper shaft.

2. The industrial machine of claim 1, wherein the attachment includes a hydraulic actuator for actuating the attachment, the conduit providing fluid to the hydraulic actuator.

3. The industrial machine of claim 2, wherein the attachment includes a bucket pivotably coupled to the second end of the elongated member, the hydraulic actuator pivoting the bucket relative to the elongated member.

4. The industrial machine of claim 1, wherein the coupling extends between the first reel and the second reel.

5. The industrial machine of claim 1, wherein the first reel and the second reel rotate in the same direction about the axis of rotation.

6. The industrial machine of claim 4, wherein the fluid coupling is offset from the axis of rotation.

7. The industrial machine of claim 1, wherein the elongated member is extendable through a crowd length, wherein the first reel includes a surface onto which at least a portion of the first portion of the conduit is wrapped, the surface defining a circumference that is approximately equal to the crowd length.

8. The industrial machine of claim 1, wherein the elongated member engages the shipper shaft such that rotation of the shipper shaft drives the elongated member for translational movement relative to the boom.

9. An industrial machine comprising:

a frame supporting a fluid source and a boom;

a shipper shaft supported on the boom;

a handle movably supported on the shipper shaft for translational and rotational movement relative to the boom;

an attachment coupled to the handle;

a conduit including a first portion, a second portion, and a fluid coupling, the first portion in fluid communication with a portion of the attachment, the second portion in fluid communication with the fluid source, the fluid coupling including a first end in fluid communication with the first portion of the conduit and a second end in fluid communication with the second portion of the conduit;

a first reel supporting the first portion of the conduit, the first reel being supported on a support shaft, the first reel being rotatable to reel in and pay out the first portion of conduit as the attachment moves relative to the boom;

a second reel supporting the second portion of the conduit, the second reel being rotatable to reel in and pay out the second portion of the conduit as the attachment moves relative to the boom; and a gear transmission for transmitting torque from the shipper shaft to the support shaft, the gear transmission including a pinion and at least one gear member, the pinion coupled to the shipper shaft, the pinion driving the at least one gear member to rotate the support shaft at a predetermined speed relative to the shipper shaft.

10. The industrial machine of claim 9, wherein the first reel and the second reel are rotatably supported by the support shaft, the support shaft defining an axis of rotation.

11. The industrial machine of claim 10, wherein the first reel and the second reel rotate about the axis of rotation in the same direction.

12. The industrial machine of claim 9, wherein the fluid coupling includes a first end coupled to the first portion of the conduit and a second end coupled to the second portion of the conduit, the first end positioned proximate the first reel and the second end positioned proximate the second reel.

13. The industrial machine of claim 9, wherein the first reel and the second reel are supported by the support shaft for rotation about an axis, wherein the fluid coupling is offset from the axis.

14. The industrial machine of claim 9, wherein the first reel is larger than the second reel.

15. The industrial machine of claim 9, wherein the second reel is circular.

16. The industrial machine of claim 9, wherein the first reel is rotatable about a first axis and the second reel is rotatable about a second axis, wherein the first axis and the second axis are collinear.

17. The industrial machine of claim 9, wherein the handle is extendable through a crowd length, wherein the first reel includes a surface onto which the first portion of conduit is wrapped, the surface defining a circumference that is approximately equal to the crowd distance.

18. The industrial machine of claim 9, wherein the handle engages the shipper shaft such that rotation of the shipper shaft drives the handle for movement relative to the boom.

19. The industrial machine of claim 9, wherein the attachment includes a bucket pivotably coupled to the handle and a hydraulic actuator for pivoting the bucket relative to the handle, and wherein the first portion of the conduit is in fluid communication with the hydraulic actuator.

20. An industrial machine comprising:

a frame supporting a fluid source and a boom;

a shipper shaft supported on the boom;

a handle movably supported on the shipper shaft for translational and rotational movement relative to the boom;

an attachment coupled to the handle;

an actuator for actuating the attachment;

a conduit including a first portion, a second portion, and a fluid coupling, the first portion in fluid communication with the actuator, the second portion in fluid communication with the fluid source, the fluid coupling providing fluid communication between the first portion and the second portion;

a first reel supporting the first portion of the conduit, the first reel being supported on a support shaft, the first reel rotatable to reel in and pay out the first portion of conduit as the handle moves relative to the boom;

a second reel supporting the second portion of the conduit, the second reel rotatable to reel in and pay out the second portion of the conduit as the handle moves relative to the boom; and a gear transmission for transmitting torque from the shipper shaft to the support shaft, the gear transmission including a pinion and at least one gear member, the pinion coupled to the shipper shaft, the pinion driving the at least one gear member to rotate the support shaft at a predetermined speed relative to the shipper shaft.

21. The industrial machine of claim 20, wherein the first reel and the second reel are rotatably supported by the support shaft, the support shaft defining an axis of rotation.

22. The industrial machine of claim 21, wherein the first reel and the second reel rotate about the axis of rotation in the same direction.

23. The industrial machine of claim 20, wherein the first reel and the second reel are supported by the support shaft for rotation about an axis, wherein the fluid coupling is offset from the axis.

24. The industrial machine of claim 20, wherein the first reel defines a larger diameter than the second reel.

25. The industrial machine of claim 20, wherein the second reel is circular.

26. The industrial machine of claim 20, wherein the handle is extendable through a crowd length, wherein the first portion of conduit is wrapped onto at least a portion of the first reel, the length of the wrapped first portion defining a distance approximately equal to the crowd length.

27. The industrial machine of claim 20, wherein the handle engages the shipper shaft such that rotation of the shipper shaft drives the handle for movement relative to the boom.

28. The industrial machine of claim 20, wherein the attachment includes a bucket pivotably coupled to an end of the handle, and wherein the actuator includes a fluid cylinder coupled between the handle and the bucket such that actuation of the fluid cylinder pivots the bucket relative to the handle.

29. The industrial machine of claim 20, wherein the second reel is coupled to the first reel, rotation of one of the first reel and the second reel causing rotation of the other of the first reel and the second reel.

30. The industrial machine of claim 4, wherein the second reel is coupled to the first reel, rotation of one of the first reel and the second reel causing rotation of the other of the first reel and the second reel.

31. The industrial machine of claim 9, wherein the second reel is coupled to the first reel, rotation of one of the first reel and the second reel causing rotation of the other of the first reel and the second reel.

32. The industrial machine of claim 9, wherein the second reel reels in the second portion of the conduit concurrently with one of the first reel reeling in the first portion of the conduit and the first reel paying out the first portion of the conduit.

33. The industrial machine of claim 9, wherein the second portion of the conduit is suspended between the second reel and the fluid source in a slack state.

* * * * *